US006776651B1

(12) United States Patent
Liu

(10) Patent No.: US 6,776,651 B1
(45) Date of Patent: Aug. 17, 2004

(54) STACKED ELECTRONIC CONNECTOR

(75) Inventor: Lu-Ta Liu, Taipei (TW)

(73) Assignee: Lankom Electronics Co., Ltd., Taipei (TW)

( * ) Notice: Subject to any disclaimer, the term of this patent is extended or adjusted under 35 U.S.C. 154(b) by 0 days.

(21) Appl. No.: 10/465,580

(22) Filed: Jun. 20, 2003

(51) Int. Cl.[7] ..... H01R 3/00
(52) U.S. Cl. ..... 439/490; 439/541.5; 439/620
(58) Field of Search ..... 439/92, 541.5, 439/95, 107, 490, 607, 620, 676

(56) References Cited

U.S. PATENT DOCUMENTS 6,302,741 B1 * 10/2001 Fasold et al. ..... 439/620
6,428,361 B1 * 8/2002 Imschweiler et al. ..... 439/676
6,511,348 B1 * 1/2003 Wojtacki et al. ..... 439/620
6,699,065 B1 * 3/2004 Espenshade et al. ..... 439/490

* cited by examiner

*Primary Examiner*—Khiem Nguyen
(74) *Attorney, Agent, or Firm*—Rabin & Berdo, P.C.

(57) ABSTRACT

A stacked electronic connector includes a hollow mounting block, a first type connector socket and a second type connector socket. The mounting block has a front, a rear, two opposite sides, two inner guides, defined inside the mounting block and two windows through two corners where the front and the sides of the mounting block meet. The second type connector socket has two indicator lights and two arms. Each arm has a front end and an inclined edge formed at the front end that are held in the corresponding windows. Consequently, light produced by the indicator lights will be transmitted through the arms to the front ends and the inclined edges of the arms. A person can see the light from various directions.

5 Claims, 8 Drawing Sheets

STACKED ELECTRONIC CONNECTOR

BACKGROUND OF THE INVENTION

1. Field of the Invention

The present invention relates to a stacked electronic connector, and more particularly to a stacked electronic connector that allows connection conditions to be verified from different directions.

2. Description of Related Art

Typically, RJ-45 modular socket assemblies are used to connect a computer to a network, such as the Internet, a wide area network (WAN) or a local area network (LAN). Universal serial bus (USB) connectors are used to connect peripheral devices to computers. An RJ-45 modular socket assembly often has visual indicators such as LEDs to indicate that the RJ-45 modular socket assembly is connected. However, the indicators in a conventional stacked electronic connector can only be viewed from in front of the stacked electronic connector. Being able to see the indicators from only one specific direction is inconvenient.

To overcome the shortcomings, the present invention provides a stacked electronic connector to mitigate or obviate the aforementioned problems.

SUMMARY OF THE INVENTION

The main objective of the invention is to provide a stacked electronic connector that permits a person to see connection indicators from different directions.

Other objectives, advantages and novel features of the invention will become more apparent from the following detailed description when taken in conjunction with the accompanying drawings.

DETAILED DESCRIPTION OF PREFERRED EMBODIMENT

With reference to FIGS. 1 to 4, a stacked electronic connector comprises a conductive outer casing (not numbered), a hollow mounting block (10), a first type connector socket such as a USB connector (12) and a second type connector socket such as an RJ-45 modular socket assembly (20).

The mounting block (10) is housed in the outer casing and has a front (not numbered), a rear (not numbered), two opposite sides (not numbered), a top inner space (not numbered), two inner guides (not numbered), a bottom inner space (not numbered) and a rear inner space (not numbered). The front and the opposite sides of the mounting block (10) form two opposite front side corners (not numbered). The top inner space is defined through the front of the mounting block (10). The bottom inner space is defined through the front of the mounting block (10) under the top inner space. The rear inner space is defined through the rear of the mounting block (10) and communicates with the top inner space. The inner guides are defined respectively in opposite sides of the mounting block (10) from the rear to the front in the top inner space and form two windows (14) respectively in the two front side corners.

The USB connector (12) is conventional and is mounted in the bottom inner space of the mounting block (10).

Figure 5:
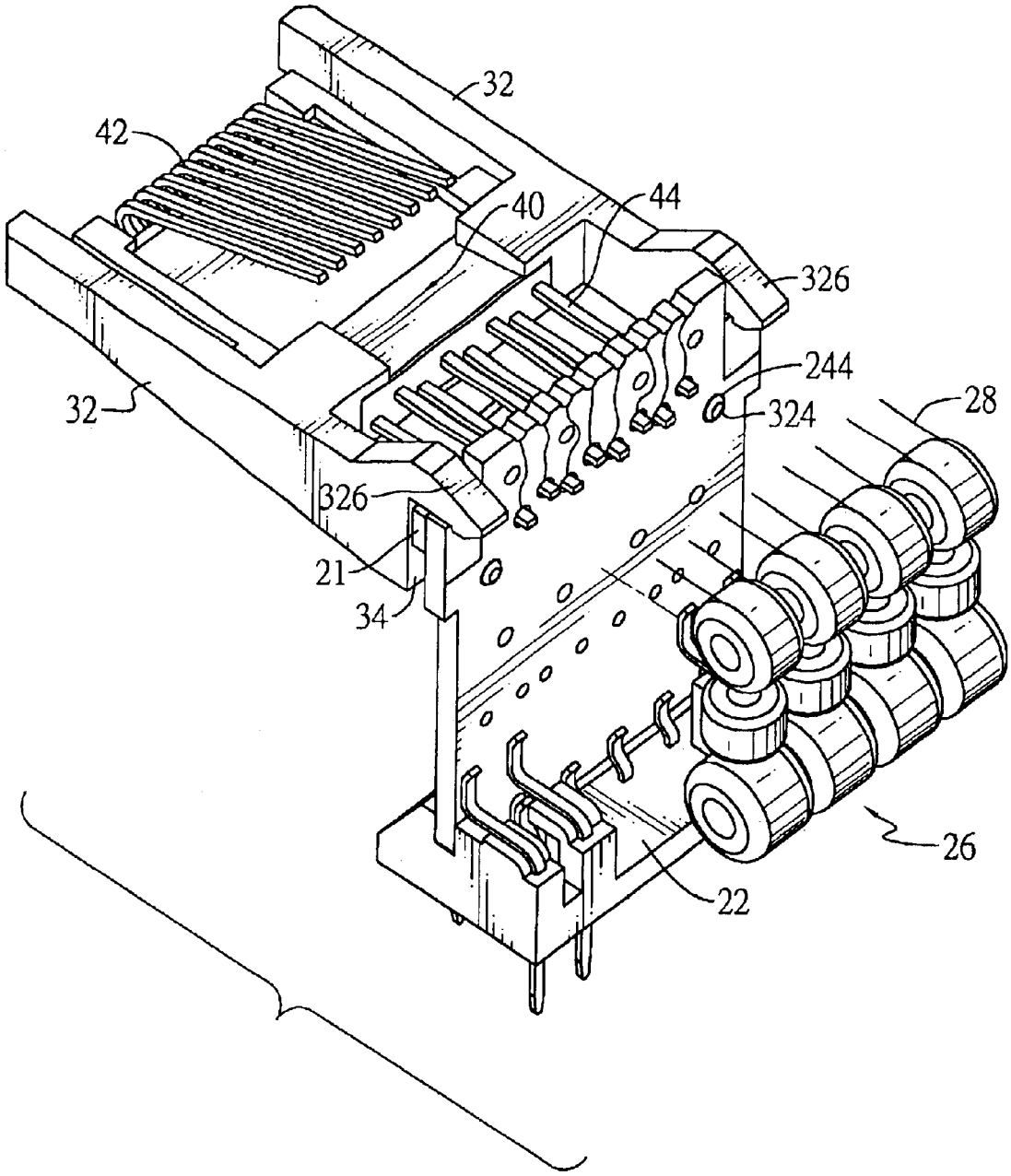
FIG. 5 is an exploded rear perspective view of the RJ-45 modular socket assembly in FIG. 4 with a transformer assembly.
Figure 6:
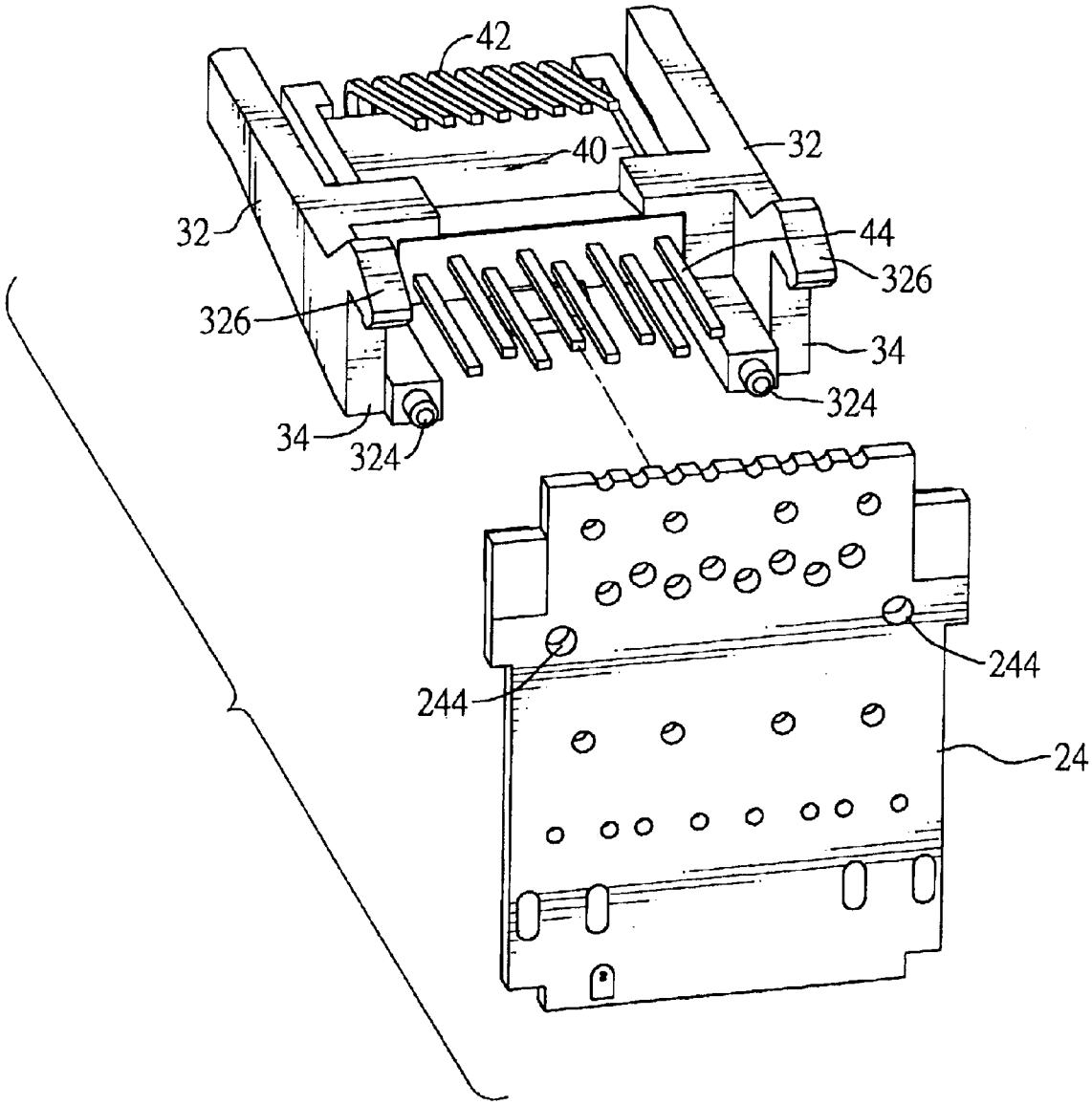
FIG. 6 is an exploded rear perspective view of the RJ-45 modular socket assembly in FIG. 4.
Figure 7:
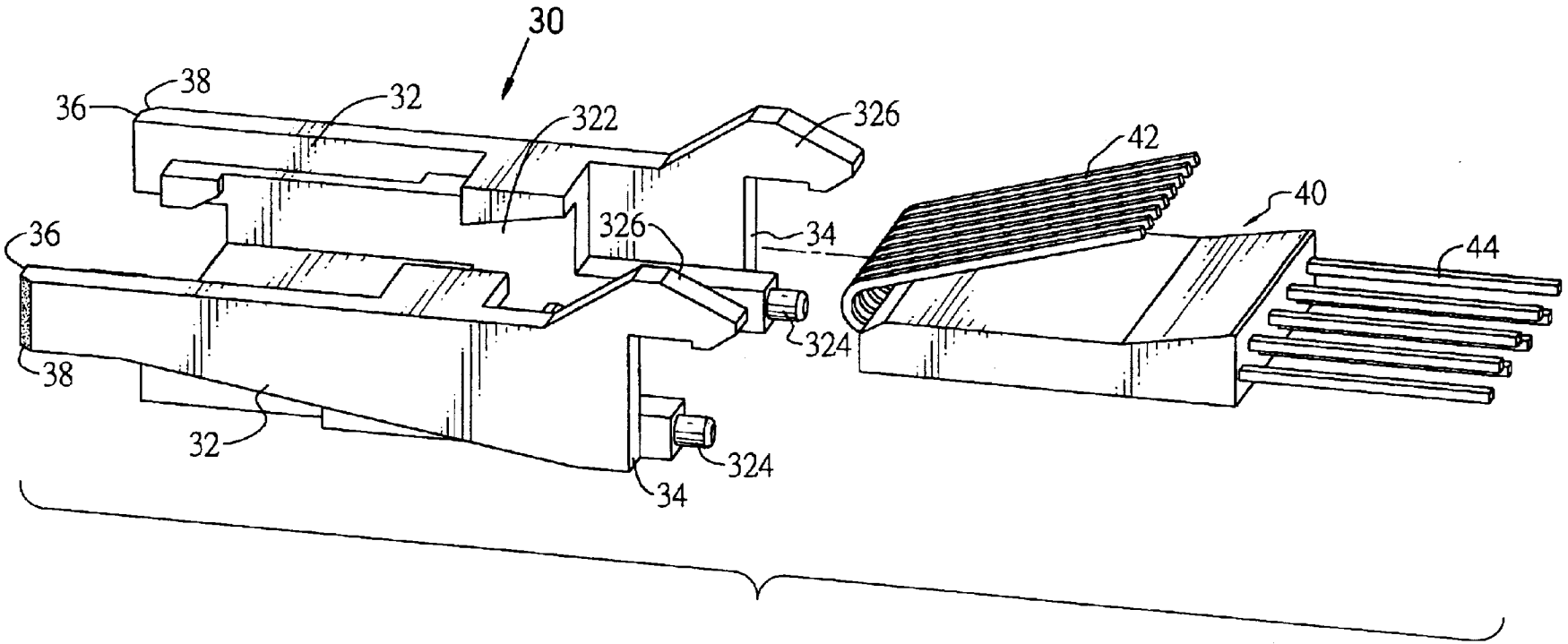
FIG. 7 is an exploded perspective view of an inside bracket and a contact holder of the RJ-45 modular socket assembly in FIG. 4.

With further reference to FIGS. 5, 6 and 7, the RJ-45 modular socket assembly (20) is mounted in the top and rear spaces in the mounting block (10). The RJ-45 modular socket assembly (20) comprises a mounting seat (22), a printed circuit board (24), a transformer assembly (26), an inside bracket (30), indicator lights (21), eight conductive contacts (not numbered) and a contact holder (40). The mounting seat (22) is mounted in the rear inner space of the mounting block (10) and has a top (not numbered). The printed circuit board (24) is mounted perpendicularly on the top of the mounting seat (22) and has a top edge (not numbered), a top portion (not numbered), a front (not numbered), two opposite sides (not numbered), a rear (not numbered) and two mounting holes (244). The mounting holes (244) are defined through the top portion of the printed circuit board (24) respectively near opposite sides from the front to the rear. The transformer assembly (26) is attached to the rear of the printed circuit board (24) and is electrically connected to the printed circuit board (24) by wires (28). The inside bracket (30) is U-shaped and is mounted on the top portion on the front of the printed circuit board (24) and comprises a base (not numbered) with two sides (not numbered), two arms (32), a contact block (not numbered) and two mounting stubs (324). The arms (32) are made of light-transmitting material, and are formed respectively on the two sides of the base and are perpendicular to the base. Each arm (32) has a front end (36), an inclined edge (38), a rear end (34) and a hook (326). Each front end (36) has an outside edge (not numbered), and the inclined edge (38) is formed on the outside edge of the front end (36) of each arm (32). Furthermore, the outside edge of the front end (36) and the inclined edge (38) of each arm (32) can have multiple small bumps (not numbered) to diffuse the light transmitted through the outside edges of the front ends (36) and the inclined edges (38) of the arms (32). The hook (326) is formed on and extends from the rear end (34) of each arm (32).

The contact block is formed integrally between the arms (32) and has two sides (not numbered), a rear end (not numbered), a slot (322) and two rectangular parallelepiped protrusions (not numbered). The rectangular parallelepiped protrusions are formed respectively on the two sides of the contact block, extend from the rear end of the contact block and respectively have rear ends (not numbered) that extend toward the printed circuit board (24). The mounting stubs (324) are formed respectively on the rear ends of the rectangular parallelepiped protrusions and correspond to the mounting holes (244) in the printed circuit board (24). The hooks (326) hook over and hold the top edge of the printed circuit board (24) to securely hold the inside bracket (30) in place when the mounting stubs (324) are mounted respectively in the mounting holes (244).

A gap (not numbered) is formed between the rear end (34) of each arm (32) and the front of the printed circuit board (24). The indicator lights (21) such as light-emitting diodes (LEDs) are mounted on the front of the printed circuit board (24) respectively in the gaps and correspond respectively to the rear ends (34) of the arms (32). Light produced by the indicator lights (21) enters the rear end (34) of the arms (32) and is transmitted to the outside edge of the front end (36) and the inclined edge (38) of each arm (32).

The contact holder (40) has a front end (not numbered) and a rear end (not numbered), securely holds the conductive contacts and is mounted in the slot (322) of the contact block from the rear of the inside bracket (30). The rear end of the contact holder (40) is flared to securely wedge into the slot (322) of the contact block.

The conductive contacts are respectively held in the contact holder (40) and respectively have inclined contacts (42) and longitudinal contacts (44). The inclined contacts (42) protrude from the front end of the contact holder (40), and the longitudinal contacts (44) protrude from the rear end of the contact holder (40). The inclined contacts (42) are bent back toward the printed circuit board (24). The longitudinal contacts (44) are electrically connected to the printed circuit board (24) by soldering.

The arms (32) are respectively mounted in the inner guides in the mounting block (10) and the front ends (36) and the inclined edges (38) are held in and are visible through the windows (14). Therefore, the light produced by the indicator lights (21) and transmitted through the arms (32) to the outside edges of the front ends (36) and the inclined edges (38) can be seen from different directions besides just the front.

Figure 1:
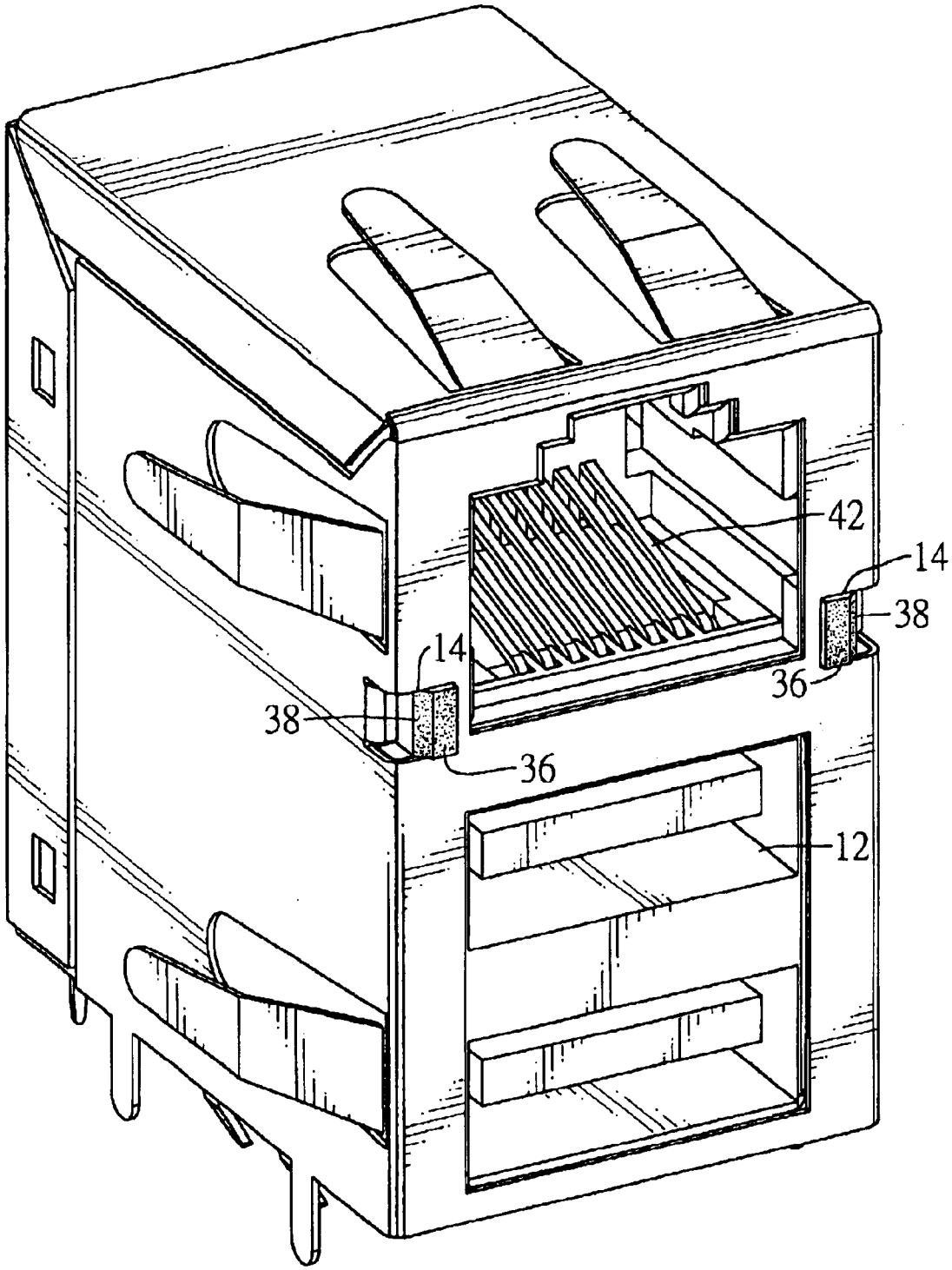
FIG. 1 is a perspective view of a stacked electronic connector in accordance with the present invention.
Figure 2:
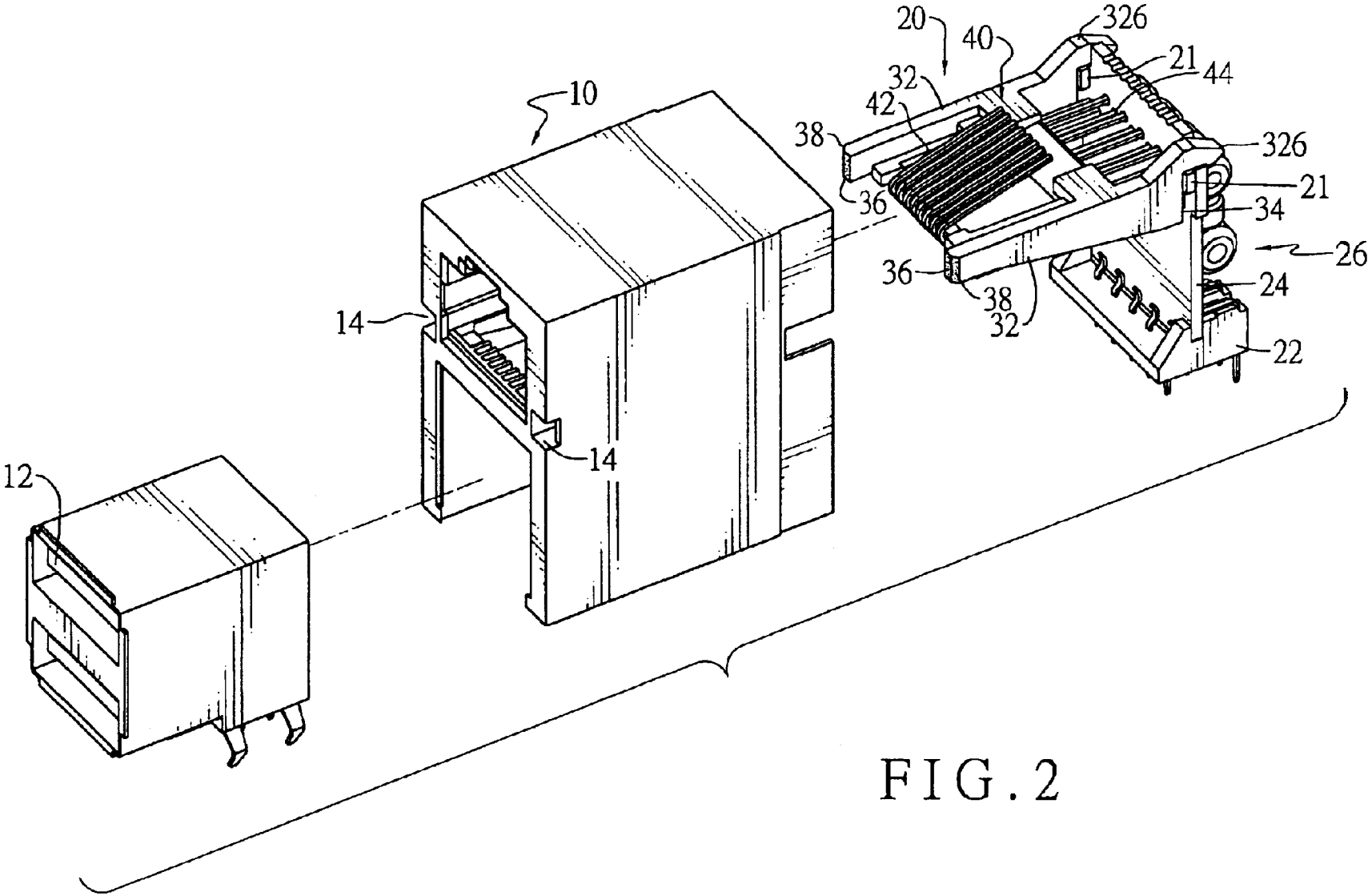
FIG. 2 is an exploded perspective view of the stacked electronic connector in FIG. 1 without an outer casing.
Figure 3:
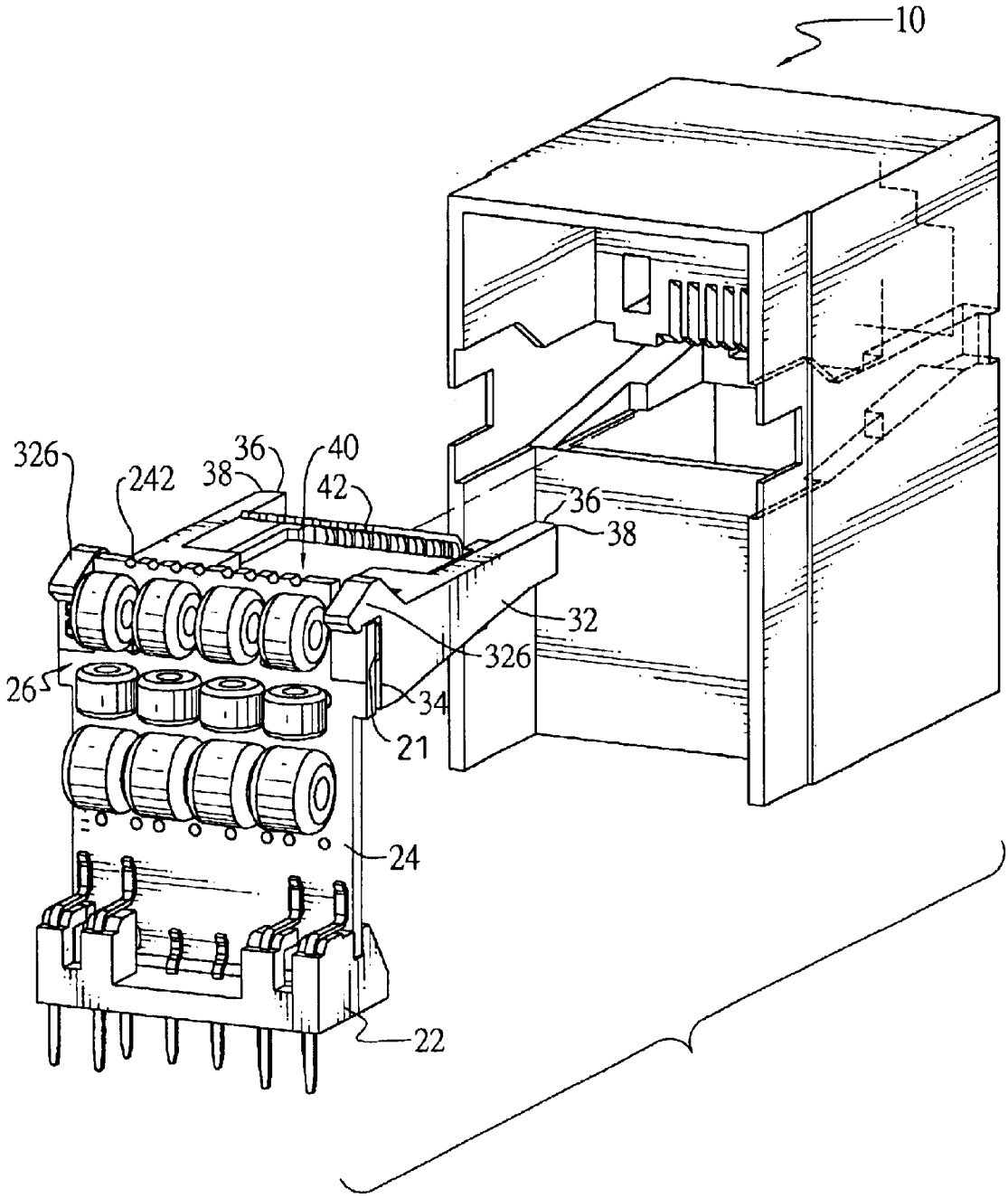
FIG. 3 is an exploded perspective rear view of the stacked electronic connector in FIG. 1 without the outer casing.
Figure 4:
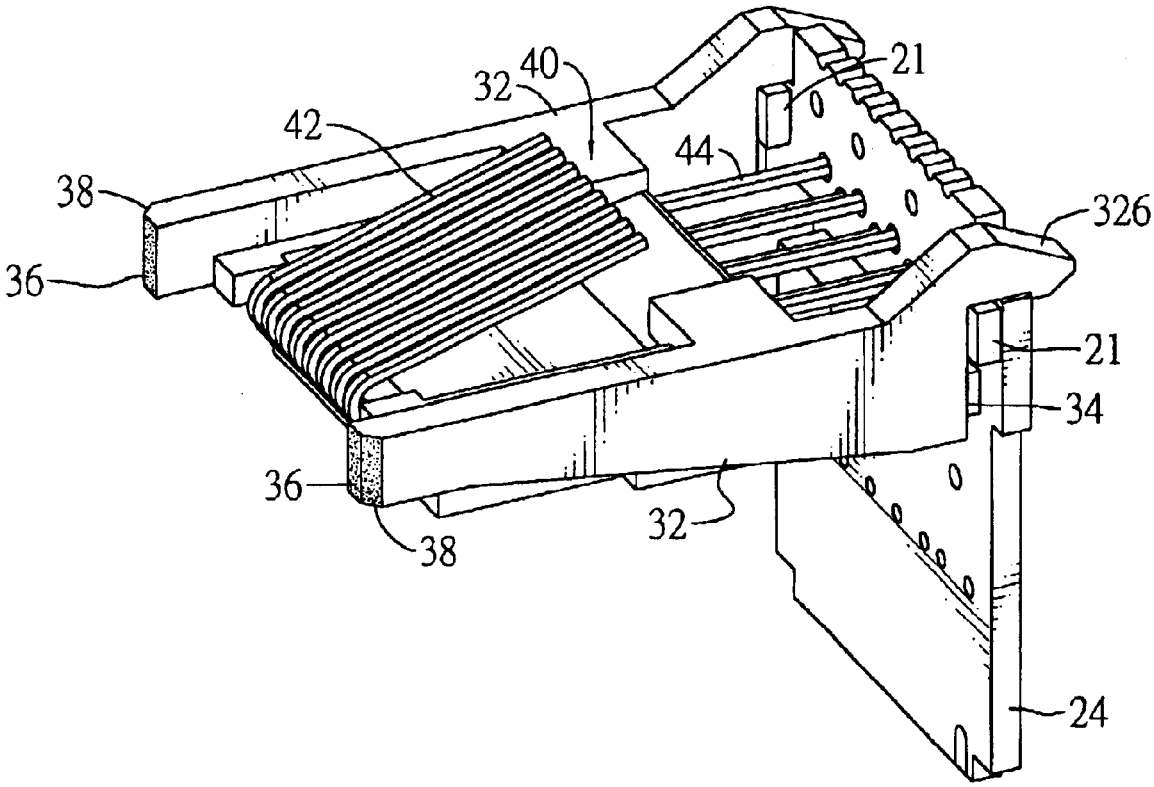
FIG. 4 is a perspective view of an RJ-45 modular socket assembly without a transformer assembly for the stacked electronic connector in FIG. 1.
Figure 8:
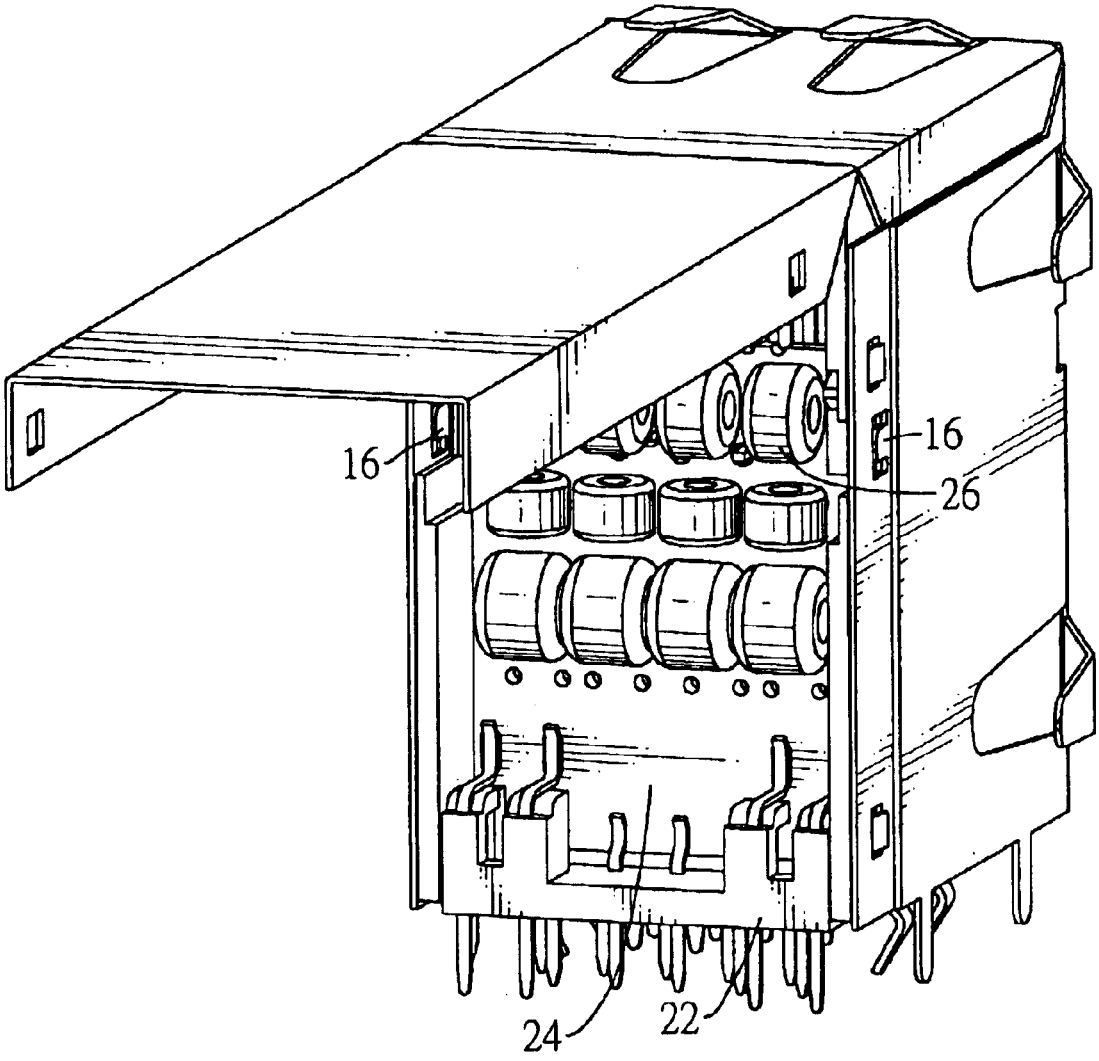
FIG. 8 is a rear perspective view of the stacked electronic connector in FIG. 1.

With reference to FIGS. 1 and 8, the outer casing is mounted around the mounting block (10), has two tabs (16) and two secondary windows (not numbered) and electrically connected to the printed circuit board (24). The two tabs (16) are bent and soldered to the printed circuit board (24) to electrically connect the outer casing to the printed circuit board (24) for ground. The two secondary windows (not numbered) correspond to the windows (14) in the mounting block (10) to allow the outside edges of the front ends (36) and the inclined edges (38) can be visible.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked electronic connector comprising:

a mounting block with a front, a rear, two opposite sides and two front side corners formed at the front and respectively on the sides of the mounting block and the mounting block having a top inner space formed through the front of the mounting block;

a bottom inner space formed through the front of the mounting block under the top inner space;

a rear inner space formed through the rear of the mounting block and communicating with the top inner space; and two inner guides defined in the mounting block from the rear to the front respectively at the sides of the mounting block in the rear inner and the top inner spaces, and to form two windows respectively through the front side corners of the mounting block;

a first type connector socket mounted in the bottom inner space of the mounting block;

a second type connector socket mounted in the top inner and rear inner spaces of the mounting block and the second type connector socket comprising a mounting seat with a top mounted in the rear inner space;

a printed circuit board mounted perpendicular on the top of the mounting seat and having a top edge, a top portion, a front, a rear and two opposite sides;

a transformer assembly mounted on the rear of the printed circuit board and electrically connected to the printed circuit board;

an inside bracket mounted in the rear inner and top inner spaces of the mounting block and at the top edge on the front of the printed circuit board, and having a base with two sides, two arms and a contact block, the arms being made of light-transmitting material and formed respectively at the two sides of the base and perpendicular to the base, each arm mounted in a respective one of the inner guides and having a front end with an outside edge held in and visible through a corresponding one of the windows, a rear end mounted on the top edge at the sides of the printed circuit board to form a gap between the rear end of each arm and the front of the printed circuit board, and an inclined edge defined in the outside edge of the front end of each arm, facing outward and held in and visible through a corresponding one of the windows, and the contact block formed integrally between the arms and having a slot;

at least one indicator light mounted on the front of the printed circuit board, received in each gap and corresponding to the rear end of a respective one of the arms;

a contact holder mounted in the slot of the contact block, having a front end and a rear end and held by the contact block; and multiple conductive contacts mounted in the contact holder and respectively having inclined contacts and longitudinal contacts, the inclined contacts extending from the front end of the contact holder and the longitudinal contacts extending from the rear end of the contact holder, the inclined contacts being bent back toward the printed circuit board, and the longitudinal contacts connected electrically to the printed circuit board; and a conductive outer casing mounted around the mounting block, electrically connected to the printed circuit board for grounding and having two secondary windows corresponding to the windows in the mounting block to allow the front ends and the inclined edges to be visible.

2. The stacked electronic connector claimed in claim 1, wherein each arm further has a hook formed on the rear end to hook the top edge of the printed circuit board, the printed circuit board further has two mounting holes defined through the top portion from the front to the rear of the printed circuit board, and the contact block further has a rear, two sides, two rectangular parallelepiped protrusions each having a rear end extending toward the printed circuit board and formed respectively on the sides of the contact block, and a mounting stub protruding from the rear end of each rectangular parallelepiped protrusion, corresponding to a respective one of the mounting holes and held in the corresponding one of the mounting holes.

3. The stacked electronic connector as claimed in claim 1, wherein the outside edge of the front end and the inclined edge of each arm further have multiple small bumps.

4. The stacked electronic connector as claimed in claim 2, wherein the outside edge of the front end and the inclined edge of each arm further have multiple small bumps.

5. The stacked electronic connector as claimed in claim 4, wherein the at least one indicator light is LED.

* * * * *